US005282006A

United States Patent [19]

Fletcher

[11] Patent Number: 5,282,006

[45] Date of Patent: Jan. 25, 1994

[54] TRANSFER SYSTEM INCLUDING PRE-TRANSFER PRESSURE TREATMENT APPARATUS

[75] Inventor: Gerald M. Fletcher, Pittsford, N.Y.

[73] Assignee: Xerox Corporation, Stamford, Conn.

[21] Appl. No.: 986,315

[22] Filed: Dec. 7, 1992

[51] Int. Cl.[5] ..... G03G 15/16

[52] U.S. Cl. ..... 355/273; 430/126

[58] Field of Search ..... 355/271, 273, 274; 430/126

[56] References Cited

U.S. PATENT DOCUMENTS

| | | | |
|---|---|---|---|
| 3,854,974 | 12/1974 | Sato et al. | 430/126 |
| 3,959,574 | 5/1976 | Seanor et al. | 492/56 |
| 4,947,214 | 8/1990 | Baxendell et al. | 355/274 |
| 4,974,027 | 11/1990 | Landa et al. | 355/273 X |
| 5,016,055 | 5/1991 | Pietrowski et al. | 355/273 |
| 5,081,500 | 1/1992 | Snelling | 355/273 |

FOREIGN PATENT DOCUMENTS

| | | | |
|---|---|---|---|
| 61-84658 | 4/1986 | Japan | 355/273 |

*Primary Examiner*—Joan H. Pendegrass
*Attorney, Agent, or Firm*—Dennis A. Robitaille

[57] ABSTRACT

An apparatus for transferring a developed toner image from an image bearing surface to a support substrate including a corona generating device for establishing a transfer field, and a pressure treatment apparatus for compacting the toner image on the image bearing surface. The pressure treatment apparatus substantially prevents premature transfer of toner across air gaps between the image bearing surface and the support substrate.

24 Claims, 1 Drawing Sheet

TRANSFER SYSTEM INCLUDING PRE-TRANSFER PRESSURE TREATMENT APPARATUS

Figure 1:
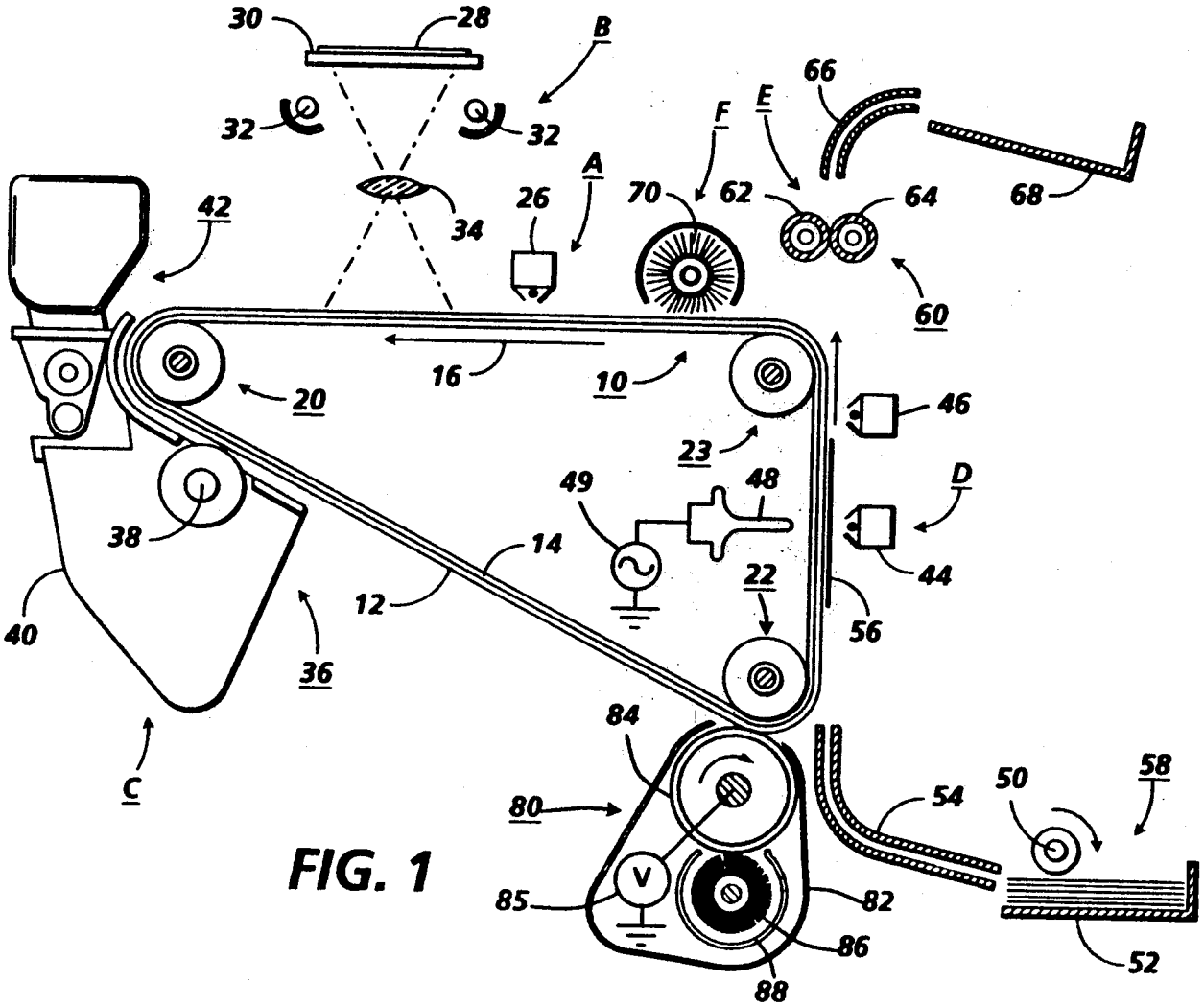

The present invention relates generally to a system for transfer of charged toner particles in an electrostatographic printing apparatus, and more particularly concerns a method and apparatus for using pressure treatment in combination with vibratory energy and electrostatic transfer fields for enhanced toner transfer in an electrostatographic printing machine.

Generally, the process of electrostatographic copying is executed by exposing a light image of an original document onto a substantially uniformly charged photoreceptive member. Exposing the charged photoreceptive member to a light image discharges a photoconductive surface thereon in areas corresponding to non-image areas in the original document while maintaining the charge in image areas, thereby creating an electrostatic latent image of the original document on the photoreceptive member. Charged developing material is subsequently deposited onto the photoreceptive member such that the toner particles are attracted to the charged image areas on the photoconductive surface thereof to develop the electrostatic latent image into a visible image. This developed image is then transferred from the photoreceptive member, either directly or after an intermediate transfer step, to a copy sheet or other support substrate, creating an image on the copy sheet corresponding to the original document. The transferred image may then be permanently affixed to the copy sheet through a process called "fusing". In a final step, the photoconductive surface of the photoreceptive member is cleaned to remove any residual developing material thereon in preparation for successive imaging cycles.

The electrostatographic copying process described above is well known and is commonly used for light lens copying of an original document. Analogous processes also exist in other electrostatographic printing applications such as, for example, digital printing where the latent image is produced by a modulated laser beam, or ionographic printing and reproduction, where charge is deposited on a charge retentive surface in response to electronically generated or stored images.

The process of transferring charged toner particles from an image bearing support surface to a second support surface such as a copy sheet or an intermediate transfer belt is realized at a transfer station. The transfer process is enabled by overcoming adhesion forces holding the toner particles to the image bearing surface. In a conventional electrostatographic machine, transfer is achieved by applying electrostatic force fields in a transfer region sufficient to overcome the forces which hold the toner particles to the photoconductive surface on the photoreceptive member. These electrostatic force fields operate to attract and transfer the toner particles over onto the second support surface. Historically, transfer of toner images between support surfaces in electrostatographic applications has been accomplished via electrostatic induction using a corona generating device, wherein the second supporting surface is placed in direct contact with the developed toner image being supported on the image bearing surface (typically a photoconductive surface) while the back of the second supporting surface is sprayed with a corona discharge. This corona discharge generates ions having a polarity opposite that of the toner particles, thereby electrostatically attracting and transferring the toner particles from the image bearing surface to the second support surface. An exemplary corotron ion emission transfer system is disclosed in U.S. Pat. No. 2,836,725.

Unfortunately, the interface between the image bearing surface and the second support surface is not always optimal. Particularly, with non-flat copy sheets, such as copy sheets that have already passed through a fixing operation (e.g., heat and/or pressure fusing), perforated sheets, or sheets that are brought into imperfect contact with the charge retentive surface, the contact between the sheet and the image bearing surface may be non-uniform, being characterized by gaps where contact will fail. There is a tendency for toner not to transfer across these gaps, causing a copy quality defect referred to as transfer deletion.

As described, the process of transferring development materials in an electrostatographic system involves the physical detachment and transfer-over of charged toner particles from an image bearing surface into attachment with a second surface via electrostatic force fields. In addition, other forces, such as mechanical pressure or vibratory energy, have been used to enhance the transfer process. The critical aspect of the transfer process focuses on applying and maintaining high intensity electrostatic fields as well as other forces in the transfer region to overcome the adhesive forces acting on the toner particles. Careful control of these electrostatic fields and other forces is required to induce the physical detachment and transfer-over of the charged toner particles without scattering or smearing of the developer material.

The problem of transfer deletion has been addressed by various means. For example, mechanical devices that force the second support surface into intimate and complete contact with the image bearing surface have been incorporated into transfer systems. Using this approach, blade arrangements have been proposed for sweeping over the back side of the second supporting surface at the entrance to the transfer region. Alternatively, acoustic agitation or the use of vibratory energy has been disclosed as a method for enhancing toner release from the image bearing surface. Generally, systems which initiate this method incorporate a resonator suitable for generating vibratory energy arranged in line with the back side of the image bearing surface to apply uniform vibratory energy thereto. Toner is thereby released from the image bearing surface despite the fact that electrostatic charges in the transfer zone may be insufficient to attract toner from the image bearing surface to the second support surface.

The following disclosures may be relevant to various aspects of the present invention:

U.S. Pat. No. 3,854,974
Patentee: Sato, et al.
Issued: Dec. 17, 1974

U.S. Pat. No. 4,947,214
Patentee: Baxendell, et al.
Issued: Aug. 7, 1990

U.S. Pat. No. 5,016,055
Patentee: Pietrowski, et al.
Issued: May 14, 1991

U.S. Pat. No. 5,081,500
Patentee: Snelling

Issued: Jan. 14, 1992

The relevant portions of the foregoing disclosures may be briefly summarized as follows:

U.S. Pat. No. 3,854,974 to Sato et al. discloses a method for transferring a toner image from a toner substrate to a transfer sheet by bringing the toner substrate and the transfer sheet into face to face contact and applying a vibration thereto, while simultaneously applying pressure and/or an electrical field across the transfer sheet.

U.S. Pat. No. 4,947,214 to Baxendell et al. discloses an apparatus for transferring a developed image from a photoconductive surface to a copy sheet, including a corona generating device and a transfer assist blade. The corona generating device establishes a transfer field that is effective to attract the developed image from the photoconductive surface to the copy sheet. The blade is moved from a non-operative position spaced from the copy sheet, to an operative position, in contact therewith for pressing the copy sheet into contact with the developed image on the photoconductive surface to substantially eliminate any spaces therebetween during the transfer process.

U.S. Pat. No. 5,016,055 to Pietrowski et al. and U.S. Pat. No. 5,081,500 disclose a method and apparatus for using vibratory energy in combination with the application of a transfer field for enhanced transfer in electrophotographic imaging. An electrophotographic device, including a flexible belt-type transfer member or a sheet of paper is brought into intimate contact with a charge retentive member bearing a developed latent image at a transfer station for electrostatic transfer of toner from the charge retentive surface to the sheet. At the transfer station, a resonator suitable for generating vibratory energy is arranged in line contact with the back side of the charge retentive surface for uniformly applying vibratory energy to the charge retentive member such that toner will be released from the forces adhering it to the charge retentive surface at the line contact position by means of electrostatic and mechanical forces. In those areas characterized by non-intimate contact of the sheet with the charge retentive surface, toner is transferred across the gap by the combination of vibratory energy and the electrostatic transfer process, despite the fact that the charge on the paper would not normally be sufficient to attract toner to the sheet from the charge retentive surface.

In accordance with one aspect of the present invention, there is provided a system for transferring a toner image from an image bearing surface to a support substrate, including means for applying a charge to the support substrate to attract the toner image from the image bearing surface to the support substrate, means for applying pressure to the toner image on the image bearing surface prior to transfer of the toner image from the image bearing surface to the support substrate to substantially compact the toner image on the image bearing surface. The present invention may also include means for applying vibratory energy to the image bearing member to enable toner release therefrom, and means coupled to the pressure applying means for generating electrostatic fields during the pre-transfer pressure treatment to substantially prevent transfer of toner from the image bearing surface to the pressure applying means.

In accordance with another aspect of the present invention, there is provided an electrostatographic printing machine of the type in which a toner image is transferred from an image bearing surface to a support substrate via a transfer system, comprising means for applying a charge to the support substrate to attract the toner image from the image bearing surface to the support substrate and means for applying pressure to the toner image on the image bearing surface prior to transfer of the toner from the image bearing surface to the support substrate to substantially compress the toner image on the image bearing surface. This aspect of the invention may further include means for applying vibratory energy to the image bearing member to facilitate toner release therefrom as well as means coupled to the pressure applying means for generating electrostatic fields during the pre-transfer pressure treatment to substantially prevent transfer of toner from the image bearing surface to the pressure applying means.

In accordance with yet another aspect of the present invention, a method of transferring a toner image from an image bearing surface to a support substrate is provided, including the steps of attracting the toner image from the image bearing surface to the support substrate, and compacting the toner image on the image bearing surface substantially prior to the transfer zone.

These and other aspects of the present invention will become apparent from the following description in conjunction with the accompanying drawing, in which:

FIG. 1 is an enlarged schematic side view of an illustrative electrophotographic reproducing machine including an illustrative embodiment of the transfer assembly of the present invention, showing the pre-transfer pressure applying means of the present invention.

While the present invention will be described with reference to a preferred embodiment thereof, it will be understood that the invention is not to be limited to this preferred embodiment. On the contrary, it is intended that the present invention cover all alternatives, modifications, and equivalents as may be included within the spirit and scope of the invention as defined by the appended claims. Other aspects and features of the present invention will become apparent as the following description progresses, with specific reference to the drawing.

For a general understanding of an exemplary electrostatographic printing machine incorporating the features of the present invention, a schematic depiction of the various machine components is provided in FIG. 1. Although the apparatus of the present invention is particularly well adapted for use in an automatic electrophotographic reproducing machine as shown in FIG. 1, it will become apparent from the following discussion that the present transfer assembly is equally well suited for use in a wide variety of electrostatographic processing machines as well as many other known printing systems. It will be further understood that the present invention is not necessarily limited in its application to the particular embodiment or embodiments shown and described herein.

Moving now to a description of FIG. 1, prior to discussing the specific features of the present invention in detail, the exemplary electrophotographic reproducing apparatus employs a belt 10 including a photoconductive surface 12 deposited on an electrically grounded conductive substrate 14. Drive roller 22, coupled to motor 24 (not shown) by any suitable means, as for example a drive belt, is engaged with belt 10 for transporting belt 10 in the direction of arrow 16 about a curvilinear path defined by drive roller 22, and rotatably mounted tension rollers 20, 23. This system of rollers 20, 22, 23 is used for advancing successive portions of photoconductive surface 12 through various processing stations, disposed about the path of movement thereof, as will be described.

Initially, a segment of belt 10 passes through charging station A. At charging station A, a corona generating device or other charging apparatus, indicated generally by reference numeral 26, charges photoconductive surface 12 to a relatively high, substantially uniform potential.

Once charged, the photoconductive surface 12 is advanced to imaging station B where an original document 28, positioned face down upon a transparent platen 30, is exposed to a light source, i.e., lamps 32. Light rays from the light source are reflected from the original document 28 for transmission through a lens 34 to form a light image of the original document 28 which is focused onto the charged portion of photoconductive surface 12. The imaging process has the effect of selectively dissipating the charge on the photoconductive surface 12 in areas corresponding to non-image areas on the original document 28 for recording an electrostatic latent image of the original document 28 onto photoconductive surface 12. Although an optical imaging system has been shown and described herein for forming the light image of the information used to selectively discharge the charged photoconductive surface 12, one skilled in the art will appreciate that a properly modulated scanning beam of energy (e.g., a laser beam) or other means may be used to irradiate the charged portion of the photoconductive surface 12 for recording a latent image thereon.

After the electrostatic latent image is recorded on photoconductive surface 12, belt 10 advances to development station C where a magnetic brush development system, indicated generally by reference numeral 36, deposits particulate toner material onto the electrostatic latent image. Preferably, magnetic brush development system 36 includes a single developer roll 38 disposed in developer housing 40. In the developer housing 40, toner particles are mixed with carrier beads, generating an electrostatic charge therebetween which causes the toner particles to cling to the carrier beads to form developing material. The magnetic developer roll 38 is rotated in the developer housing 40 to attract the developing material therein, forming a "brush" comprising carrier beads with toner particles magnetically attached thereto. As the developer roller 38 continues to rotate, the brush contacts belt 10 where developing material is brought into contact with the photoconductive surface 12 such that the latent image thereon attracts the toner particles from the developing material to develop the latent image into a visible image. A toner particle dispenser, indicated generally by reference numeral 42, is also provided for furnishing a supply of additional toner particles to housing 40 in order to sustain the developing process.

After the toner particles have been deposited onto the electrostatic latent image for creating a toner image thereof, belt 10 becomes an image bearing support surface for advancing the developed image to transfer station D. In accordance with the present invention, the toner image passes through pressure treatment apparatus 80 prior to arriving at the transfer station. The details of the pressure treatment apparatus will be discussed subsequently.

At transfer station D, a sheet of support material 56 is moved into contact with the developed toner image via sheet feeding apparatus 58 and chute 54 for placing the sheet 56 into synchronous contact with the developed toner image. Preferably, sheet feeding apparatus 58 includes a feed roller 50 which rotates while in frictional contact with the uppermost sheet of stack 52 for advancing sheets of support material into chute 54, to guide the support material 56 into contact with photoconductive surface 12 of belt 10. The developed image on photoconductive surface 12 thereby contacts the advancing sheet of support material 56 in a timed sequence and is transferred thereon at transfer station D.

In the illustrated embodiment, a corona generating device 44 charges the copy sheet to the proper potential so that it is tacked to photoreceptor belt 10 and the toner image is attracted from photoreceptor belt 10 to the sheet 56. The preferred embodiment of the present invention also includes a relatively high frequency acoustic or ultrasonic resonator 48, driven by an AC source 49, which is arranged in vibratory relationship with the back side of belt 10, at a position corresponding to the location of transfer corona generator 44. The acoustic resonator 48 applies vibratory energy to the belt 10 for agitating the toner developed in imagewise configuration thereon to provide mechanical release of the toner particles from the surface of the belt 10. It has been found that such vibratory energy enhances toner transfer in areas where gaps exist due to imperfect contact between a sheet of support material 56 and belt 10. For example, some publishing applications require imaging onto high quality papers having surface textures which prevent uniform intimate contact of the paper with the developed toner images. Also, in duplex printing systems, even initially flat paper can become cockled as the result of the first side fusing step. Color images can contain areas in which intimate contact of toner with paper during the transfer step is prevented by adjacent areas of high toner pile heights. The lack of intimate contact in these situations can inhibit transfer and result in image deletion, i.e., image areas where transfer has failed to occur. Acoustically assisted transfer, as provided by the acoustic resonator 48, is a technique that helps reduce the occurrence of such deletions by using acoustic energy to minimize the forces that retard toner migration toward the copy substrate. In addition, the acoustic resonator of the present invention provides increased transfer efficiency with lower than normal transfer fields. Such increased transfer efficiency not only yields better copy quality, but also results in improved toner use efficiency as well as a reduced load on the cleaning system. Exemplary acoustic transfer assist subsystems are described in U.S. Pat. Nos. 5,016,055 and 5,081,500 of common assignee, the relevant portions of which are hereby incorporated by reference into the present application for patent. Further details of acoustically assisted xerographic toner transfer can also be found in The Society for Imaging Science and Technology (IS&T) Final Program and Proceedings, 8th International Congress on Advances in Non-Impact Printing Technologies, Oct. 25–30, 1992 in an article entitled "Acoustically Assisted Xerographic Toner Transfer", by Crowley, et al. The contents of this paper are incorporated by reference herein.

After transfer, a corona generator 46 charges the copy sheet 56 with an opposite polarity to detack the copy sheet for belt 10, whereupon the sheet 56 is stripped from belt 10. The support substrate may also be an intermediate surface or member, which carries the toner image to a subsequent transfer station for transfer to a final support surface. These types of surfaces are also charge retentive in nature. Further, while belt type members are described herein, it will be recognized that other substantially non-rigid or compliant members may also be used with the invention. The support material 56 is subsequently separated from the belt 10 and transported to a fusing station E. Fusing station E includes a fuser assembly, indicated generally by the reference numeral 60, which preferably comprises a heated fuser roll 62 and a support roll 64 spaced relative to one another for receiving a sheet of support substrate 56 therebetween. The toner image is thereby forced into contact with the support material 56 between fuser rollers 62 and 64 to permanently affix the toner image to support material 56. After fusing, chute 66 directs the advancing sheet of support material 56 to receiving tray 68 for subsequent removal of the finished copy by an operator.

Invariably, after the support material 56 is separated from belt 10, some residual developing material remains adhered to the photoconductive surface 12 thereof. Thus, a final processing station, namely cleaning station F, is provided for removing residual toner particles from photoconductive surface 12 subsequent to transfer of the toner image to the support material 56 from belt 10. Cleaning station F can include a rotatably mounted fibrous brush 70 for physical engagement with photoconductive surface 12 to remove toner particles therefrom by rotation thereacross. Removed toner particles are stored in a cleaning housing chamber (not shown). Cleaning station F can also include a discharge lamp (not shown) for flooding photoconductive surface 12 with light in order to dissipate any residual electrostatic charge remaining thereon in preparation for a subsequent imaging cycle.

The foregoing description should be sufficient for the purposes of the present application for patent to illustrate the general operation of an electrophotographic reproducing apparatus incorporating the features of the present invention. As described, the electrophotographic reproducing apparatus may take the form of any of several well known devices or systems. Variations of specific electrostatographic processing subsystems or processes may be expected without affecting the operation of the present invention.

Referring now to the datails of the present invention, with continued reference to FIG. 1, it is noted that a phenomenon called "toner splatter" is a well known problem associated with toner transfer systems. This problem usually occurs in the region immediately prior to the transfer zone, the so-called pre-transfer zone, where excessively high transfer fields can result in premature transfer across the air gap. Under these conditions, toner particles transferred across an air gap have a tendency to bounce about, skip, or scatter on the second support surface before coming to rest thereon. Toner splatter can also occur within the transfer zone during transfer of the toner, or past the transfer zone during transport, due to instability of the toner image that can occur when mutual electrostatic repulsion of the charged toner particles overcomes the mutual adhesive forces holding the toner particles together. Toner splatter leads to decreased resolution or blurred images and a lower latitude of acceptable system operating parameters. In practice, it has generally been found that severe toner splatter problems associated with transfer across air gaps can be prevented by keeping transfer fields below a threshold value necessary to initiate toner transfer at air gaps greater than about 50 microns. Experience has also shown that pressure treatment of the toner within the transfer zone can help to reduce the toner splatter that occurs within or past the the transfer zone. The presumed mechanism for this reduced toner splatter is increased toner-to-toner adhesion created by the pressure treatment in the transfer zone such that the toner image is more stable in spite of electrostatic repulsion between individual toner particles.

It will be appreciated that the acoustic transfer assist system described herein as a part of a preferred embodiment of the present invention can actually exacerbate the toner splatter problem as the acoustic resonator operates to minimize the forces retaining toner particles on the image bearing surface to enhance toner transfer across air gaps. Thus, although acoustic loosening may be desirable for increased transfer efficiency, the issue of degradation in copy quality can become an ultimate concern. This concern is particularly noteworthy with respect to high quality pictorial color imaging systems, as well as process color systems characterized by high mass/area toner images. The present invention is particularly directed toward the problem of toner scatter in an acoustically assisted transfer system by providing pre-transfer pressure treatment of the toner image to compact the toner pile on the image bearing surface prior to transfer therefrom in the transfer zone. It will be appreciated that, although pre-transfer pressure treatment as disclosed by the present invention is advantageous for reducing toner splatter, an acoustically assisted transfer system is also advantageous for reducing the extra adhesion forces that can occur between the toner image and the image bearing surface due to the pre-transfer pressure treatment of the toner image. Thus, when the image bearing surface at the pre-transfer pressure zone causes adhesion between the toner and image bearing surface to be too high, as might occur, for example, with high surface energy materials at the interface between the image bearing surface and the toner image, loss of transfer efficiency in the transfer zone can ultimately occur when the electrostatic transfer forces can not overcome the adhesive forces between the toner and the image bearing surface. Acoustically assisted transfer can reduce the adhesive forces and thereby prevent the concern of reduced transfer efficiency as caused by the pre-transfer pressure treatment.

In accordance with the present invention, a pre-transfer pressure treatment apparatus 80 is provided, including a pressure roll 84 disposed within a housing 82 mounted adjacent belt 10. The roll 84 is pressed into contact with the toner powder image on photoconductive surface 12, or the image bearing surface, for compressing the toner pile on the belt 10 prior to pre-transfer pressure treatment zone prior to the advancement of the toner pile into the transfer zone adjacent transfer corotron 44 and optional acoustic resonator 48. While pressure roller 84 is shown in alignment with, and pressing against, drive roller 22, it will be noted that this configuration is not specifically required, such that the pressure treatment apparatus 80 can be positioned at various locations along the belt 10 between the developing station C and the transfer station D. In particular, the pre-transfer pressure treatment station may be configured as part of the developer housing hardware such that hardware could be shared for the purpose of economizing to provide reduced cost or for meeting space requirement.

It is an important feature of the present invention that the pressure roll 84 is driven in the same direction as the image bearing surface and at a speed substantially equal to the speed of belt 10, for example, by means of a drive motor (not shown), which may be the same drive motor associated with drive roll 22. This directional and speed requirement minimizes drag against the toner image on the image bearing surface which could result in image distortion. Preferably, a speed mismatch condition of less than about a 0.25% difference between the pressure roller velocity and the image bearing surface velocity will avoid unacceptable image distortion in very high stress cases, such as high image pile height conditions. It will be appreciated, however, that speed mismatch conditions even above 1.0% can be acceptable without severe image distortion when the system operates at low stress conditions such as, for example, very small size toner particles with low image pile height conditions and with low friction pressure rollers. The specific speed mismatch condition allowed can be easily experimentally determined for any given specific set of materials and input image conditions.

Although the present invention is particularly well-suited for the combination of pre-transfer pressure treatment with acoustically assisted transfer systems, it will be recognized by those of skill in the art that the invention is not restricted to acoustically assisted transfer systems. That is, even without acoustically assisted transfer, pre-transfer pressure treatment may be beneficial for reducing toner splatter or for increasing operating transfer setpoint latitude relative to splatter problems, and it will be seen that some advantage for reducing background on the output copy during the pre-transfer pressure treatment can be simultaneously realized along with the beneficial reduction of toner splatter defects. For example, when the adhesion between the toner image and the image bearing member, generated by the pre-transfer pressure treatment is sufficiently small, as can occur, for example, with low surface energy materials at the interface between the toner and the image bearing surface, the transfer efficiency problem associated with the pre-transfer pressure treatment can be avoided even without acoustically assisted transfer. In practice, this behavior has been seen when the surface energy at the interface is near or below 28 dynes/cm, as for example with tedlar materials at the toner and image bearing surface interface, available from E. I. DuPont de Nemours, Inc. of Wilmington, Del. It can be appreciated that specific requirements for this interface will depend on factors such as the chemical formulation of the the toner materials. A determination of whether or not the requirements are met are best left to simple adhesion measurements or to a determination of the ability of the system to electrostatically remove the toner after the pre-transfer pressure treatment without acoustically assisted transfer means. Thus, the benefits of pre-transfer pressure treatment as disclosed by the present invention, can sometimes be realized in systems that do not necessarily include acoustically assisted transfer.

In order to substantially prevent toner transfer from image regions on the image bearing surface to the pressure roller during the pre-transfer pressure treatment provided by the present invention, it may be advantageous to apply electrostatic forces on the toner in the pressure roller nip. Such electrostatic forces may be generated by means of a biasing source 85, coupled to the pressure roller 84, for insuring appropriate surface charge conditions on the pressure roller 84. The electrostatic forces generated by biasing source 85 are directed away from the pressure roller surface and are sufficiently high to overcome any attractive adhesive forces that might occur between the pressure roller and the toner. For example, positively charged toner will require an electrostatic field between the toner and pressure roller that is directed away from the pressure roller toward the image bearing surface. Negatively charged toner will require the opposite. For positively charged toner, for example, the measured potential above the pressure roller surface away from the pressure nip must be more positive than the measured potential above the toner images on the image bearing surface to create a field away from the pressure roller surface. The difference between these two measured potentials is called the "equivalent applied potential" for the system. This equivalent applied potential must be positive for positive polarity toner and negative for negative polarity toner in the image regions. The measured potential above the pressure roll will in the general case, be a linear addition of the applied potential on the pressure roller substrate and the potentials due to trapped surface or volume charge distributions in the pressure roller materials. The measured potential above the image bearing surface just prior to the pressure roll nip will be due to a combination of any applied potential on its substrate, a potential term due to any surface or volume charge distributions in the image bearing materials, and a term due to the toner charge on the image bearing surface. Assuming positive polarity toner in image regions, it is desirable to apply as high a positive equivalent applied potential as possible to the pressure roll 84 for preventing toner transfer to the pressure roll due to adhesion forces between the toner and the pressure roller 84. However, the equivalent applied potential must not substantially exceed air breakdown limits in the pre-nip region of the pressure roller 84, and it must not substantially exceed air breakdown limits in small air gaps that may be present in the pressure roller nip. The former can cause transfer defects in the subsequent transfer step, and the latter can reverse the polarity of some of the toner such that further increases of the equivalent applied potential will then result in increasing toner transfer to the pressure roller 84 rather than the desired decreasing toner transfer. These limits can be estimated analytically or may be determined experimentally.

Although the equivalent applied potential on the pressure roller 84 can be achieved by surface and volume charge distributions on the pressure roller 84, in practice, it is often difficult to achieve good control of these charges when the materials are very insulating. Various means to control the charges on insulators are well known in the art, for example by using conductive fiber brushes or corona devices, but these add complexity and cost. It is therefore preferred to substantially eliminate the surface and volume charges on the pressure roller 84 that may otherwise be present away from the pressure roll 84 nip by choosing materials for the pressure roller that are sufficiently conductive to substantially conduct away these charges. The main requirement here is that the "volume charge relaxation time" for conduction, which for Ohmic materials is given by the quantity dielectric constant times the volume resistivity times the permitivity of vacuum, be at least smaller than about one third of the dwell time between the cleaning stage on the pressure roller and the roller nip. The latter is given by the quantity "distance between the cleaning stage and the pressure roller nip" divided by the velocity of the pressure roller. For example, if the distance between the cleaning stage and the pressure nip of the roller is three inches, the roller speed is ten in/sec, and the dielectric constant of the roller material is three, then the preferred volume resistivity for the pressure roller will be below about $4\times10^{11}$ ohm-cm.

It must be noted that, although proper reversal fields applied by the pressure roller 84 in the present invention can prevent transfer of toner onto the pressure roller in image regions, the same applied field conditions will tend to collect "wrong signed" toners onto the pressure roller 84. In particular, developed background toner is typically " rong signed" and the pre-transfer pressure roller in this invention can thus reduce background after the pressure roller. The tendency for background toner to be wrong signed can be enhanced by selective AC corotron or AC scorotron treatment of images prior to the pre-transfer roller pressure device, as is well known and practiced in the art of xerography. Thus, background reduction by means of pre-transfer pressure treatment, with or without selective corotron or scorotron treatment, can be simultaneously realized along with the toner splatter reduction advantage caused by this invention.

The pressure treatment apparatus 80 of the present invention also includes a cleaning brush 86 and an associated vacuum housing 88 located adjacent the pressure roll 84 for cleaning toner particles and other stray contaminants away from the pressure roll 84. Alternatively, a blade cleaning system or many other types of cleaning systems well known in the art (not shown) can be incorporated into the pressure treatment apparatus to remove contaminants therefrom. In addition, it is desired that the surface of the pressure roll 84 have a low propensity for causing high adhesive forces during pressure contact with the image bearing member and the toner thereon. Often, such low propensity to high adhesive forces occurs with low surface energy materials, so that is is preferred that the pressure roller 84 be fabricated from materials below about 30 dynes/cm. Materials, such as, for example, Teflon or tedlar, available from E. I. Dupont de Nemours, Inc. of Wilimington, Del., are desirable for minimizing or preventing adhesion of toner particles to the pressure roll 84. Desired low surface energy can be achieved through choice of intrinsic properties or else through thin surface coatings of appropriate materials with low surface energy. Although these preferred materials typically have low surface energy, it has been found that the pressure treatment of the present invention can be implemented by means of a stainless steel roll with polycarbonate coatings with certain combinations of toners. Thus, although low surface energy materials for the pressure roll are desirable, this property is not necessary for all types of toner materials. Whether or not a particular materials set will be acceptable is best determined by simple experimentation with the toner set of interest.

The pressure treatment apparatus 80 of the present invention is operative to compact the toner pile on the image bearing surface of belt 10 increasing toner adhesion so that the propensity to create toner splatter during or after transfer by the corotron 44 and the optional acoustic device 48 is reduced. While the exact mechanism by which the pressure treatment apparatus 80 of the present invention is not completely understood, it is theorized that, through the use of the present invention, a bonded toner-to-toner cluster is created with increased adhesive force maintaining the toner-to-toner cluster on the image bearing member, and with increased adhesive force between toner particles. The increased adhesive force prevents the toner cluster from being transferred across large air gaps by small applied fields that may be inadvertently present in the pre-nip air gaps. The increased toner-to-toner adhesive forces reduce the tendency for electrostatic repulsion of the like charged particles to shift apart and reduce shifting of the toner during transfer. The system can be "fine-turned" to eliminate transfer in regions where air gaps are greater than those typically encountered in situations where toner deletions are an issue.

It will be appreciated by those of skill in the art that the pre-transfer pressure treatment apparatus 80 of the present invention can be implemented through various alternative means which may or may not include the pressure roll configuration of the exemplary embodiment shown in FIG. 1. For example, pressure treatment may also be accomplished by incorporating an electrically biasing source coupled to a conductive roll member for applying a reverse field to the toner.

In recapitulation, the electrophotographic printing machine of the present invention includes a toner transfer system and a pre-transfer pressure treatment apparatus including a pressure roller for applying pressure to a toner image on an image bearing surface to compact the toner image onto the image bearing surface prior to transfer under electrostatic and mechanical forces. The pre-transfer pressure treatment apparatus may include a biasing source for preventing transfer of toner from the image bearing surface to the pressure roller. The transfer system may include any electrostatic field generating device such as a corona generating device for inducing toner transfer via electrostatic force and also may include an acoustic resonator for generating vibratory energy to reduce adhesion of the toner image to the image bearing member.

It is, therefore, evident that there has been provided, in accordance with the present invention, an electrophotographic printing apparatus that fully satisfies the aims and advantages of the invention as hereinabove set forth. While the invention has been described in conjunction with a preferred embodiment thereof, it is evident that many alternatives, modifications, and variations will be apparent to those skilled in the art. Accordingly, the present application for patent is intended to embrace all such alternatives, modifications, and variations as are within the broad scope and spirit of the appended claims.

I claim:

1. A system for transferring a toner image from an image bearing surface to a support substrate, comprising means for attracting the toner image from the image bearing surface to the support substrate; and means, positioned adjacent the image bearing surface, in contact therewith, for applying pressure to the toner image on the image bearing surface prior to transfer of the toner image from the image bearing surface to the support substrate to substantially compact the toner image on the image bearing surface.

2. The transfer system of claim 1, wherein said attracting means includes a corona generating device spaced from the image bearing surface, defining a gap therebetween for receiving the support substrate therein.

3. The transfer system of claim 1, further including means for applying vibratory energy to the image bearing member to facilitate toner release therefrom.

4. The transfer system of claim 3, wherein said vibratory energy applying means includes an ultrasonic acoustic resonator.

5. The transfer system of claim 4, wherein said pressure applying means further includes drive means for rotating said roll member at a velocity substantially equivalent to the moving image bearing surface.

6. The transfer system of claim 1, wherein said pressure applying means includes a rotatable roll member positioned adjacent the image bearing surface for contact therewith.

7. The transfer system of claim 6, wherein said pressure applying means further includes an electrical biasing source coupled to said rotatable roll member for generating electrostatic forces to substantially prevent transfer of toner from said image bearing surface to said rotatable roll member.

8. The transfer system of claim 6, wherein said roll member includes a surface coating for providing said roll member with low surface energy to prevent toner from adhering thereto.

9. The transfer apparatus of claim 1, further including means for cleaning said pressure applying means.

10. The transfer apparatus of claim 9, wherein said cleaning means includes a rotatable brush for contacting said rotatable roll member.

11. An electrostatographic printing machine of the type in which a toner image is transferred from an image bearing surface to a support substrate via a transfer system, comprising:

means for attracting the toner image from the image bearing surface to the support substrate; and means, positioned adjacent the image bearing surface, in contact therewith, for applying pressure to the toner image on the image bearing surface prior to the transfer of the toner image from the image bearing surface to the support substrate to substantially compact the toner image on the image bearing surface.

12. The electrostatographic printing machine of claim 11, wherein said attracting means includes a corona generating device spaced from the image bearing surface, defining a gap therebetween for receiving the support substrate therein.

13. The electrostatographic printing machine of claim 11, further including means for applying vibratory energy to the image bearing member to enable toner release therefrom.

14. The electrostatographic printing machine of claim 13, wherein said vibratory energy applying means includes an ultrasonic acoustic resonator.

15. The electrostatographic printing machine of claim 11, further including means for cleaning said pressure applying means.

16. The electrostatographic printing machine of claim 15, wherein said cleaning means includes a rotatable brush for contacting said rotatable roll member.

17. An electrostatographic printing machine including a system for transferring a toner image from an image bearing surface to a support substrate, comprising:

means for attracting the toner image from an image bearing surface to the support substrate;

means, including a rotatable roll member positioned adjacent the image bearing surface for contact therewith, for applying pressure to the toner image on the image bearing surface prior to transfer of the toner image from the image bearing surface to the support substrate to substantially compact the toner image on the image bearing surface; and means for cleaning said pressure applying means.

18. The electrostatographic printing machine of claim 17, wherein said pressure applying means further includes drive means for rotating said roll member at a velocity substantially equivalent to the moving image bearing surface.

19. The electrostatographic printing machine of claim 17, wherein said pressure applying means includes an electrical biasing source coupled to said rotatable roll member for generating electrostatic forces to substantially prevent transfer of toner from said image bearing surface to said rotatable roll member.

20. The electrostatographic printing machine of claim 17, wherein said roll member includes a surface coating for providing said roll member with low surface energy to prevent toner from adhering thereto.

21. A method of transferring a toner image from a moving image bearing surface to a moving support substrate, including the steps of:

attracting the toner image from the image bearing surface to the support substrate;

vibrating the image bearing surface to facilitate said attracting step; and compacting the toner image on the image bearing surface substantially prior to said attracting step.

22. The method of claim 21, wherein said attracting step includes the step of charging the support substrate.

23. The method of claim 21, wherein said vibrating step includes the step of applying ultrasonic acoustic energy to the support substrate.

24. The method of claim 21, wherein said compacting step includes the step of contacting the toner image on the image bearing surface with a pressure applying apparatus.

* * * * *